US009472151B2

(12) United States Patent
Watsuda et al.

(10) Patent No.: US 9,472,151 B2
(45) Date of Patent: Oct. 18, 2016

(54) DISPLAY PANEL

(71) Applicant: INNOLUX CORPORATION, Miao-Li County (TW)

(72) Inventors: Hirofumi Watsuda, Miao-Li County (TW); Shuji Hagino, Miao-Li County (TW)

(73) Assignee: INNOLUX CORPORATION, Jhu-Nan, Miao-Li County (TW)

( * ) Notice: Subject to any disclaimer, the term of this patent is extended or adjusted under 35 U.S.C. 154(b) by 0 days.

(21) Appl. No.: 14/853,648

(22) Filed: Sep. 14, 2015

(65) Prior Publication Data

US 2016/0005371 A1 Jan. 7, 2016

Related U.S. Application Data

(63) Continuation of application No. 14/197,763, filed on Mar. 5, 2014, now Pat. No. 9,190,005.

(51) Int. Cl.
*G09G 3/36* (2006.01)

(52) U.S. Cl.
CPC ..... *G09G 3/3648* (2013.01); *G09G 3/3685* (2013.01); *G09G 2300/0404* (2013.01); *G09G 2300/0426* (2013.01); *G09G 2300/0478* (2013.01); *G09G 2310/0297* (2013.01); *G09G 2320/0219* (2013.01); *G09G 2320/0233* (2013.01); *G09G 2320/0247* (2013.01)

(58) Field of Classification Search
CPC ..... G09G 3/3648; G09G 3/3685; G09G 3/3275; G09G 2300/043; G09G 2300/0404; G09G 2300/0426; G09G 2300/0478; G09G 2310/0297; G09G 2320/0219; G09G 2320/0233; G09G 2320/0247
USPC ..... 345/92, 100
See application file for complete search history.

(56) References Cited

U.S. PATENT DOCUMENTS

| | | | | |
|---|---|---|---|---|
| 6,597,349 | B1 | 7/2003 | Koyama et al. | |
| 6,924,782 | B1 | 8/2005 | Fujioka et al. | |
| 7,728,806 | B2 | 6/2010 | Shin | |
| 8,102,346 | B2 | 1/2012 | Watanabe | |
| 8,199,079 | B2 | 6/2012 | Kim et al. | |
| 2006/0107143 | A1* | 5/2006 | Kim | G09G 3/3233 714/726 |
| 2006/0262130 | A1* | 11/2006 | Kim | G09G 3/3233 345/589 |
| 2007/0182871 | A1 | 8/2007 | Yun et al. | |
| 2008/0036704 | A1* | 2/2008 | Kim | G09G 3/3233 345/76 |
| 2008/0316150 | A1* | 12/2008 | Lee | G09G 3/3233 345/76 |

(Continued)

FOREIGN PATENT DOCUMENTS

TW 201201182 A1 1/2012

*Primary Examiner* — Tom Sheng
(74) *Attorney, Agent, or Firm* — Muncy, Geissler, Olds & Lowe, P.C.

(57) ABSTRACT

A display panel comprises a display area, a plurality of scan lines and data lines, a data driving circuit and a demultiplexing unit. The scan lines and the data lines cross each other within the display area. At least two of the data lines have different capacitances. The data driving circuit outputs a plurality of control signal and a data signal. The demultiplexing unit includes a plurality of thin-film transistors coupled with the data driving circuit and the data lines. The thin-film transistors receive the data signal and transmit the data signal to the correspondingly coupled data lines through channel layers of the thin-film transistors according to the control signals. The channel layers of at least two of the thin-film transistors coupled with the at least two data lines have different widths.

16 Claims, 8 Drawing Sheets

(56) References Cited

U.S. PATENT DOCUMENTS

2009/0273388 A1 11/2009 Yamashita
2009/0289882 A1 11/2009 Masui
2010/0156945 A1 6/2010 Yoshida
2012/0086700 A1 4/2012 Numao
2013/0300722 A1 11/2013 Gyouten et al.
2014/0285411 A1* 9/2014 Tamura ..... G09G 3/3208 345/82

* cited by examiner

DISPLAY PANEL

CROSS REFERENCE TO RELATED APPLICATIONS

This application is a Continuation application of U.S. application Ser. No. 14/197,763 filed on Mar. 5, 2014.

BACKGROUND OF THE INVENTION

1. Field of Invention

The invention relates to a display panel and, in particular, to a display panel having a non-rectangular display area.

2. Related Art

Flat display apparatuses have advantages such as low power consumption, less heat generation, light weight and non-radiation, and are therefore widely applied to various electronic products. A flat display apparatus can be divided into a passive matrix type and an active matrix type according to its driving method. Limited to the driving method, the passive matrix display apparatus is unfavorable for a long lifespan and large-scale products. Although the active matrix display apparatus is made by the advanced technology, it is suitable for the large-scale and high-definition full color display with a large information capacity and therefore has become the mainstream of the flat display apparatus.

A conventional active matrix display apparatus includes a display panel, a scan driving circuit and a data driving circuit. The scan driving circuit is electrically connected to the display panel through a plurality of scan lines, and the data driving circuit is electrically connected to the display panel through a plurality of data lines. Besides, the data lines and the scan lines cross each other to form a display area including a plurality of pixels. Once the scan driving circuit outputs a scan signal to enable the scan line, the data driving circuit transmits the pixel voltage signals to the pixel electrodes of a row of pixels through the data lines, thereby enabling the display panel to display images.

As shown in FIG. 1A, a conventional display panel 1 has a rectangular display area 11, so the data lines d within the display area 11 have the same length. Regarding to a non-rectangular display panel such as a display panel 2 having a circular display area 21 (see FIG. 1B), in case it has de-multiplexing unit, the feed-through voltages of the data lines d induced by de-multiplexing circuit are not totally the same because the lengths as well as the parasitic capacitances of the data lines d in the circular display area 21 are not identical. Accordingly, the variation of the feed-through voltages of the data lines d will result in the level shift of the common voltage (Vcom), and therefore the display panel 2 may have the undesired mura or flicker issue due to the uneven brightness.

Therefore, it is an important subject to provide a display panel that can avoid the problems of mura and flicker in a non-rectangular display area.

SUMMARY OF THE INVENTION

In view of the foregoing subject, an objective of the invention is to provide a display panel that can avoid the problems of mura and flicker in a non-rectangular display area.

To achieve the above objective, a display panel according to the invention comprises a display area, a plurality of scan lines and data lines, a data driving circuit and a demultiplexing unit. The scan lines and the data lines cross each other within the display area. At least two of the data lines have different capacitances. The data driving circuit outputs a plurality of control signal and a data signal. The demultiplexing unit includes a plurality of thin-film transistors coupled with the data driving circuit and the data lines. The thin-film transistors receive the data signal and transmit the data signal to the correspondingly coupled data lines through channel layers of the thin-film transistors according to the control signals. The channel layers of at least two of the thin-film transistors coupled with the at least two data lines have different widths.

In one embodiment, the display area is formed in a shape consisting of circle, shell, semicircle, oval, triangle, rhombus, trapezoid, polygon, or any combinations thereof.

In one embodiment, each of the thin-film transistors (TFTs) has a control terminal receiving one of the control signals, an input terminal receiving the data signal and an output terminal outputting the data signal.

In one embodiment, the data driving circuit is coupled with the control terminal of the TFT through a control signal line.

In one embodiment, the data driving circuit is coupled with the input terminal of the TFT through a data signal line.

In one embodiment, the data signal line is coupled with the input terminals of a plurality of TFTs.

In one embodiment, the plurality of TFTs include a first TFT and a second TFT, and the plurality of data lines include a first data line coupled with the first TFT and a second data line coupled with the second TFT, wherein the capacitance of the second data line is greater than that of the first data line, and the width of the channel layer of the second TFT is greater than that of the first TFT.

In one embodiment, the plurality of TFTs include a first TFT, a second TFT, and a third TFT, and the plurality of data lines include a first data line, a second data line, and a third data line coupled with the first, second, and third TFTs respectively, wherein the capacitance of the second data line is smaller than that of the third data line and is greater than that of the first data line, and the width of the channel layer of the second TFT is smaller than that of the third TFT and is greater than that of the first TFT.

In one embodiment, the plurality of TFTs include a first TFT and a second TFT, and the plurality of data lines include a first data line coupled with the first TFT and a second data line coupled with the second TFT, wherein the length of the second data line is greater than that of the first data line, and the width of the channel layer of the second TFT is greater than that of the first TFT.

In one embodiment, the plurality of TFTs include a first TFT, a second TFT, and a third TFT, and the plurality of data lines include a first data line, a second data line, and a third data line coupled with the first, second, and third TFTs respectively, wherein the length of the second data line is smaller than that of the third data line and is greater than that of the first data line, and the width of the channel layer of the second TFT is smaller than that of the third TFT and is greater than that of the first TFT.

In one embodiment, the demultiplexing unit includes a plurality of TFT groups, wherein each of the TFT groups is composed of at least two TFTs with the channel layers having the same width.

In one embodiment, the channel layers of the TFTs in the different TFT groups have different widths.

In one embodiment, the display panel further comprises at least one auxiliary capacitor. One terminal of the auxiliary capacitor is coupled to the data line that is coupled with the corresponding TFT, and the other terminal thereof is coupled to an electrode.

In one embodiment, the display panel further comprises at least one auxiliary capacitor. One terminal of the auxiliary capacitor is coupled to the data line that is coupled with the corresponding TFT, and the other terminal thereof is coupled to one of the control signal lines that is coupled with the corresponding TFT.

To achieve the above objective, a display panel according to the invention comprises a display area, a plurality of scan lines and data lines, a data driving circuit, a demultiplexing unit and at least two auxiliary capacitors. The scan lines and the data lines cross each other within the display area. At least two of the data lines have different capacitances. The data driving circuit outputs a plurality of control signal and a data signal. The demultiplexing unit includes a plurality of thin-film transistors coupled with the data driving circuit and the data lines. The thin-film transistors receive the data signal and transmit the data signal to the correspondingly coupled data lines through channel layers of the thin-film transistors according to the control signals. The channel layers of at least two of the thin-film transistors coupled with the at least two data lines have different widths. Each of the auxiliary capacitors is coupled to each of the at least two data lines, and the auxiliary capacitors have different capacitances.

In one embodiment, one terminal of each of the auxiliary capacitors is coupled to the corresponding data line, and the other one terminal of each of the auxiliary capacitors is coupled to an electrode, and wherein the data line is insulated from the electrode.

In one embodiment, each of the thin-film transistors (TFTs) has a control terminal receiving one of the control signals, an input terminal receiving the data signal, and an output terminal outputting the data signal.

In one embodiment, the data driving circuit is coupled with the control terminal of the TFT through a control signal line.

In one embodiment, one terminal of each of the auxiliary capacitors is coupled to the corresponding data line, and the other one terminal of each of the auxiliary capacitors is coupled to the control signal line, and wherein the data line is insulated from the control signal line.

As mentioned above, in the display panel of the invention, the data lines and the scan lines cross each other within the display area, and at least two data lines in the display area have different capacitances. Besides, the thin-film transistors of the demultiplexing unit receive the data signal and transmit the data signal to the correspondingly coupled data lines through channel layers of the thin-film transistors according to the control signals, and the channel layers of at least two of the thin-film transistors coupled with the at least two data lines have different widths. Accordingly, in the invention, the TFTs coupled to the data lines having different capacitances are controlled to have different widths of the channel layers, and the feed-through voltages of the data lines can be controlled. Therefore, the problem of mura and flicker of the display panel with non-rectangular display area can be avoided.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
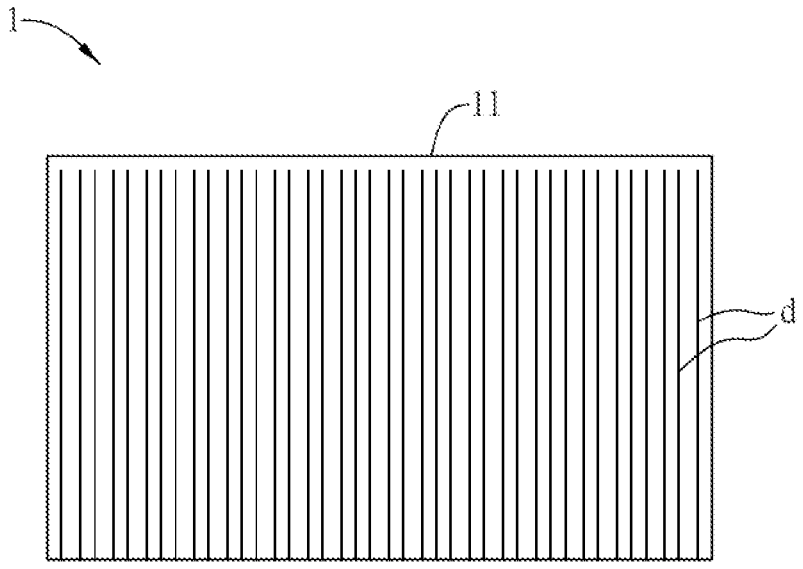
FIG. 1A (Prior Art)
FIG. 1A is a schematic diagram of a display area of a conventional display panel.
Figure 1B:
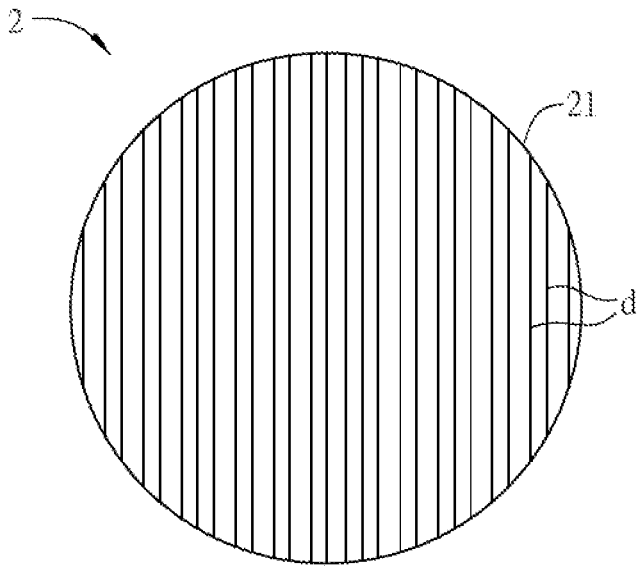
FIG. 1B (Prior Art)
FIG. 1B is a schematic diagram of a display area of another display panel.
Figure 2A:
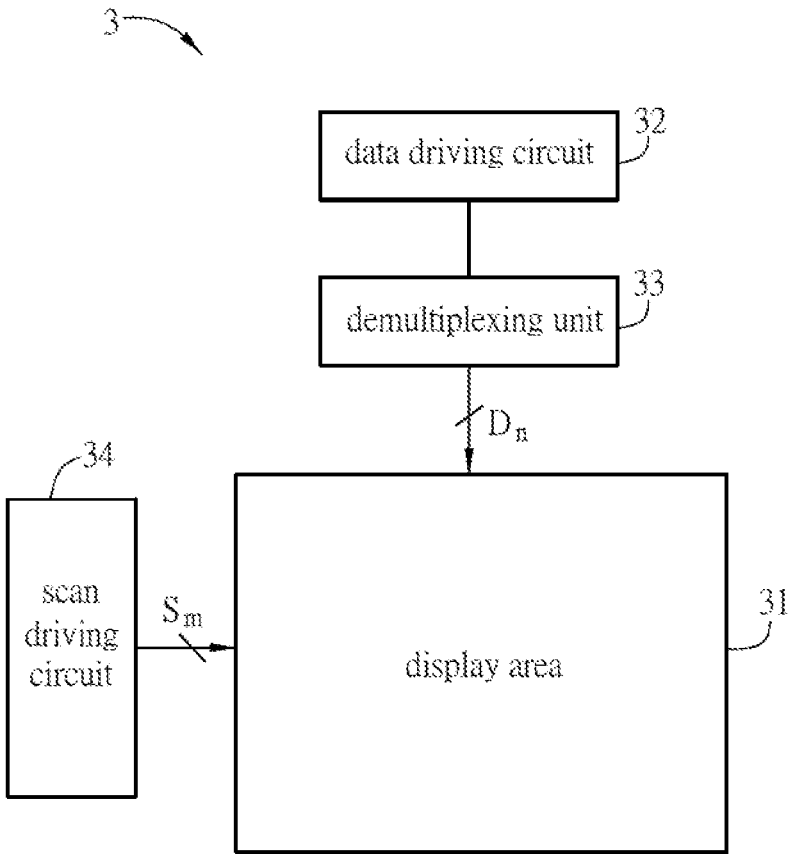
FIG. 2A is a schematic block diagram of a display panel according to an embodiment of the invention.
Figure 2B:
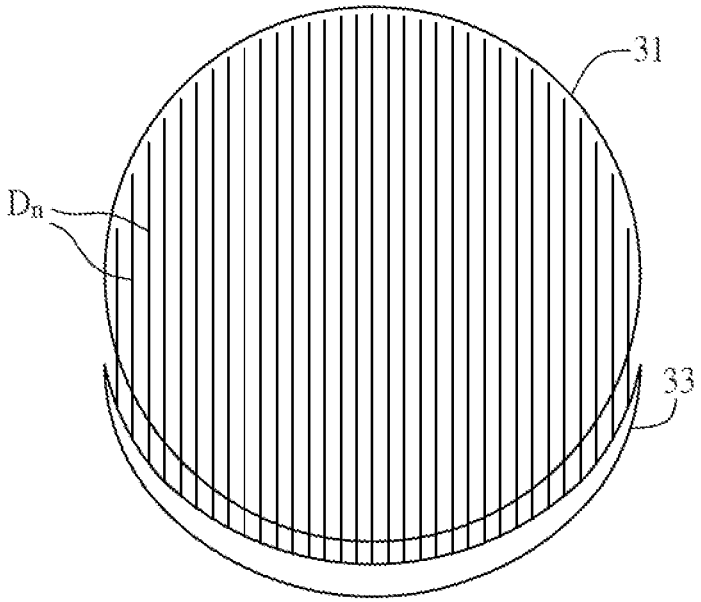
FIG. 2B is a schematic diagram showing the relation between a display area and a demultiplexing unit of the display panel in FIG. 2A.

FIG. 2A is a schematic block diagram of a display panel 3 according to an embodiment of the invention, and FIG. 2B is a schematic diagram showing the relation between a display area 31 and a demultiplexing unit 33 of the display panel 3 in FIG. 2A. The display panel 3 is an active matrix display panel and can be a liquid crystal display (LCD) panel, an organic light-emitting diode (OLED) display panel, an organic electroluminescence (EL) display panel or other kinds of display panels for example. To be noted, FIG. 2B just shows the relation between the display area 31 and the demultiplexing unit 33 while other elements of the display panel 3 are omitted.

The display panel 3 includes a plurality of scan lines $S_m$, a plurality of data lines $D_n$, a data driving circuit 32 and a demultiplexing unit 33. The display panel 3 further includes a scan driving circuit 34.

Figure 2C:
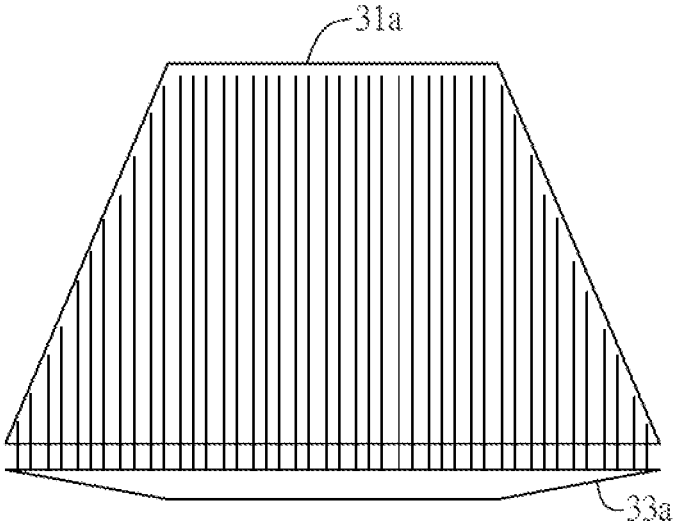
FIG. 2C is a schematic diagram showing the relation between another display area and demultiplexing unit of the display panel according to an embodiment of the invention.

The scan lines $S_m$, and the data lines $D_n$ cross each other within a display area 31, and the display area 31 has a plurality of pixels (not shown). As shown in FIG. 2B, the display area 31 of this embodiment has a circular shape for example. However, in other embodiments, as shown in FIG. 2C for example, the display area 31*a* can have a trapezoid shape or other shapes such as a shell shape, a semicircular shape, an oval shape, a triangular shape, a rhombus shape or a polygonal shape, or any combinations thereof. To be noted, the shapes of the demultiplexing units 33 and 33*a* in FIGS. 2B and 2C corresponding to the shapes of the display areas 31 and 31*a* are for illustrations only and are not tending to represent the real layout shapes of the circuits.

As shown in FIG. 2B, since the display area 31 has a circular shape, the data lines $D_n$ within the display area 31 have different lengths so as to have different parasitic capacitances. At least two of the data lines $D_n$ have different lengths. Besides, because the data lines $D_n$ having different lengths in the display area 31 also have different parasitic capacitance values, the feed-through voltages of the data lines $D_n$ will not be the same. Accordingly, the demultiplexing unit 33 of this embodiment is used to solve the problems of mura and flicker of images.

As shown in FIG. 2A, the data driving circuit 32 is electrically connected to the demultiplexing unit 33 and can output a plurality of control signal and a data signal to the demultiplexing unit 33. The control signal is a switching signal (pulse signal) and the data signal can be a gray-level voltage signal of the pixel, for example. The demultiplexing unit 33 can be a demultiplexer that is capable of transmitting a single input signal (e.g. data signal) to a plurality of output lines (e.g. data lines $D_n$). Herein, the demultiplexing unit 33 is electrically connected to the display area 31 through the data lines $D_n$. The scan driving circuit 34 is electrically connected to the display area 31 through the scan lines $S_m$ and enables the scan lines $S_m$ sequentially according to the vertical synchronization signal. When the scan lines $S_m$ are sequentially enabled, the data driving circuit 32 can transmit the pixel voltage signals of each row pixel to the pixel electrodes of the pixels of the display area through the demultiplexing unit 33 and the data lines $D_n$, thereby enabling the display panel to display images.

Figure 3A:
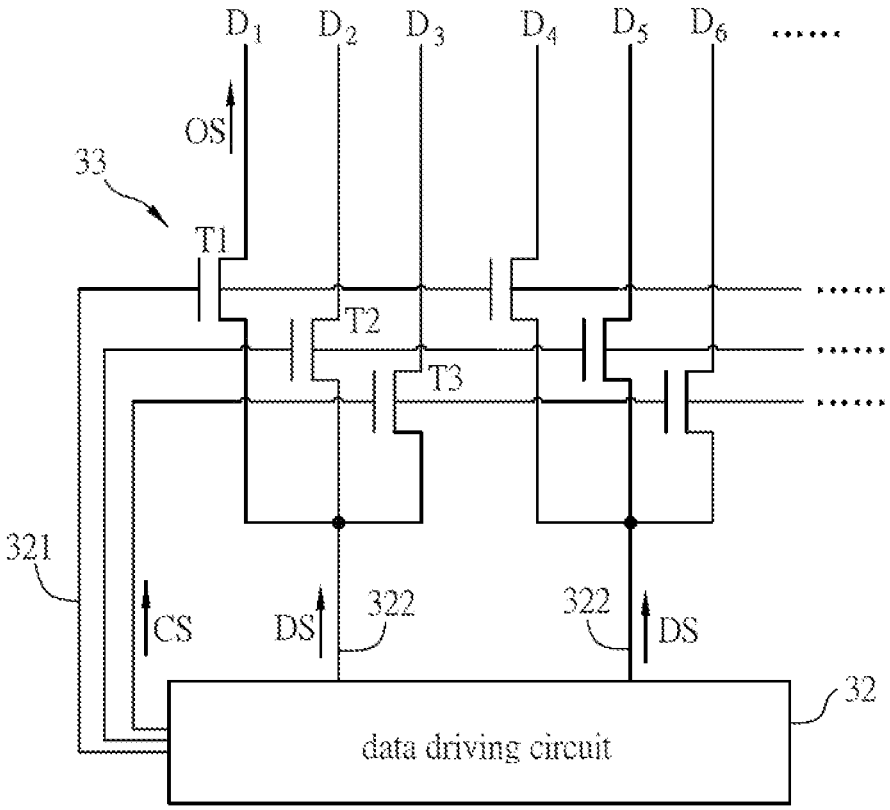
FIG. 3A is a schematic diagram of the data driving circuit and the demultiplexing unit connected to the data lines of the display panel in FIG. 2A.
Figure 3B:
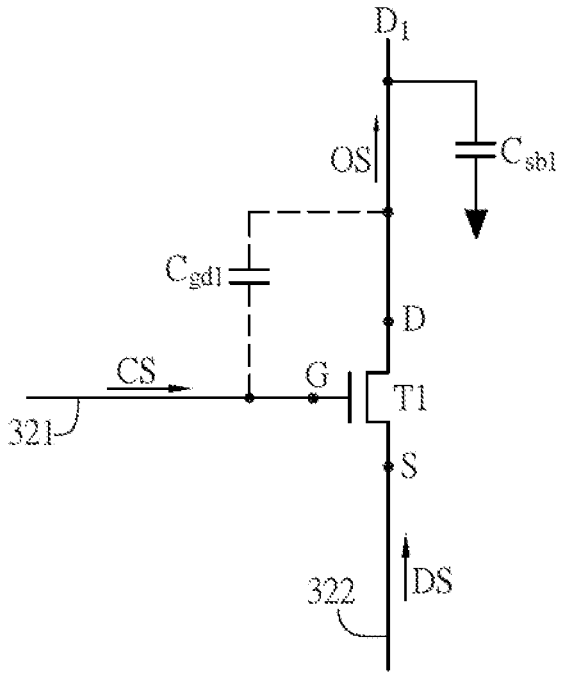
FIG. 3B is a schematic circuit diagram of a thin-film transistor (TFT) of the demultiplexing unit in FIG. 3A.
Figure 3C:
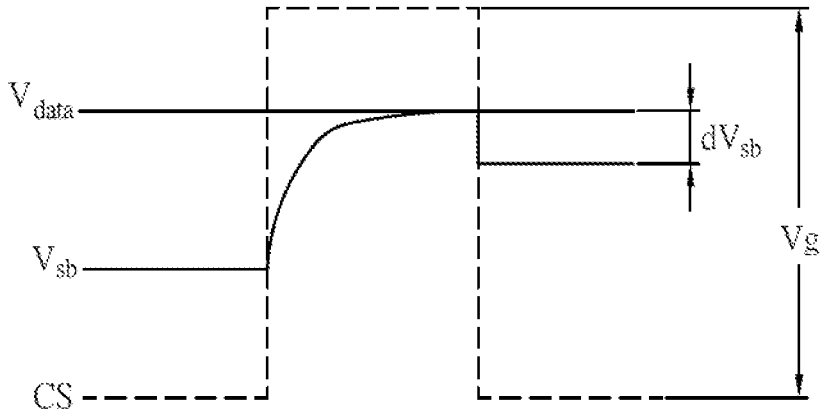
FIG. 3C is a schematic signal diagram of the TFT in FIG. 3B.

FIG. 3A is a schematic diagram of the data driving circuit 32 and the demultiplexing unit 33 connected to the data lines of the display panel 3 in FIG. 2A, FIG. 3B is a schematic circuit diagram of a thin-film transistor (TFT) T1 of the demultiplexing unit 33 in FIG. 3A, and FIG. 3C is a schematic signal diagram of the TFT T1 in FIG. 3B.

As shown in FIG. 3A, the demultiplexing unit 33 includes a plurality of TFTs (e.g. T1, T2, T3, . . . ), which are coupled with the data driving circuit 32 and the data lines (e.g. $D_1$, $D_2$, $D_3$, . . . ). As shown in FIG. 3B, the TFT T1 has a control terminal G (e.g. the gate) receiving the control signal CS, an input terminal S (e.g. the source) receiving the data signal DS and an output terminal D (e.g. the drain) outputting the data signal DS. The TFT T1 receives the data signal DS according to the control signal CS and transmits the data signal DS to the correspondingly coupled data line $D_1$ through the channel layer of the data line $D_1$. As an embodiment, the data driving circuit 32 is coupled with the control terminal G of the TFT T1 through a control signal line 321, and is coupled with the input terminal S of the TFT T1 through a data signal line 322. When the TFT T1 is enabled by the control signal CS, the data signal DS is transmitted to the input terminal S of the TFT T1 and outputted to the correspondingly coupled data line $D_1$ through the output terminal D.

In this embodiment, as shown in FIG. 3A, a data signal line 322 is connected to the input terminals of the three TFTs so that the data signal DS can be transmitted to the corresponding three data lines (indicating a pixel has three sub-pixels) through the three TFTs according to the data signal DS. However, in other embodiments, a data signal line 322 can be connected to a different number of the input terminals of the TFTs. As shown in FIG. 3A, the data signal DS is transmitted to the data line $D_1$ through the TFT T1, the data signal DS is transmitted to the data line $D_2$ through the TFT T2, and the data signal DS is transmitted to the data line $D_3$ through the TFT T3, and the rest can be deduced by analogy.

Figure 4A:
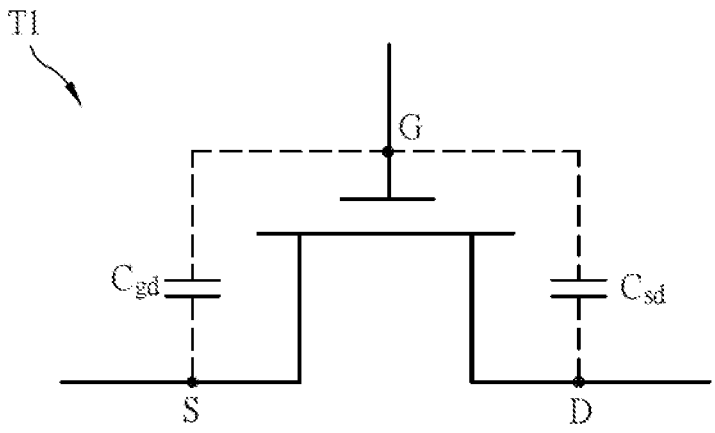
FIG. 4A is an equivalent circuit diagram of the TFT according to an embodiment of the invention.
Figure 4B:
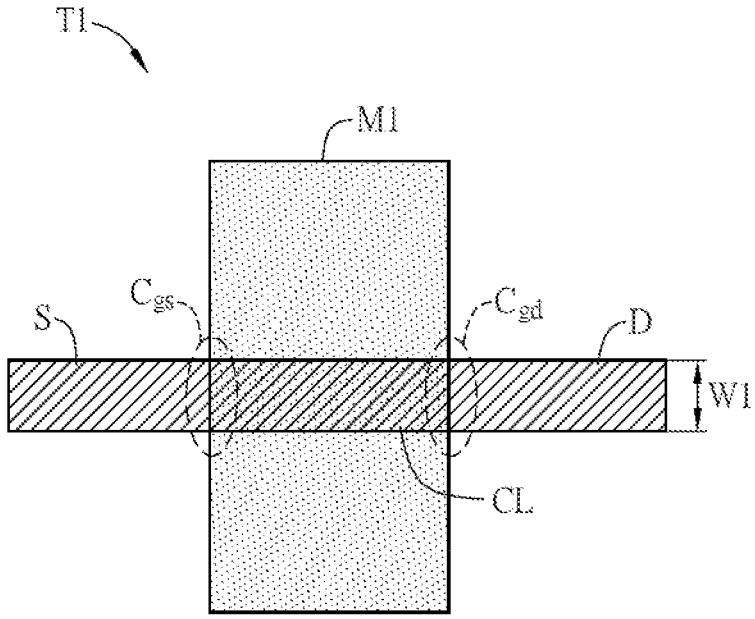
FIG. 4B is a schematic diagram of the TFT according to an embodiment of the invention.

FIG. 4A is an equivalent circuit diagram of the TFT T1, and FIG. 4B is a schematic diagram of the TFT T1.

As shown in FIGS. 4A and 4B, the TFT T1 includes a channel layer CL and a first metal layer M1, a part of channel layer CL which overlaps with a first metal layer M1 is channel of the TFT T1, and other part of channel layer CL forms drain and source of the TFT T1. A first metal layer M1 forms gate electrode of the TFT T1. The gate G and the drain D have a parasitic capacitance $C_{gd}$ therebetween, and the gate G and the source S have a parasitic capacitance $C_{gs}$ therebetween. Besides, the channel layer CL of the TFT T1 has a channel-layer width W1, which is the width of the overlap between the channel layer CL and the first metal layer M1 for example. The channel-layer width W1 is proportional to the values of the parasitic capacitances $C_{gd}$ and $C_{gs}$. In other words, when the channel-layer width W1 is increased, the values of the parasitic capacitances $C_{gd}$ and $C_{gs}$ are higher.

As shown in FIGS. 3B and 3C, $C_{sb}$ represents the parasitic capacitance of the data line $D_1$, $V_{data}$ represents the predetermined voltage to be achieved by the data line $D_1$, $V_{sb}$ represents the actual voltage of the data line $D_1$, CS represents the control signal, Vg represents the maximum amplitude of the control signal CS. Accordingly, the feed-through voltage $dV_{sb}$ ($dV_{sb}=V_{data}-V_{sb}$) of the data line D1 coupled with the TFT T1 will satisfy the following equation:

$$dV_{sb} = \frac{C_{gd}}{C_{sb} + C_{gd}} V_g$$

Because the data lines $D_n$ in the display area 31 have different lengths, the feed-through voltages of the data lines may be different, and therefore the images will be displayed with mura and flicker. From the above equation, it is found that the parasitic capacitances $C_{gd1}$, $C_{sb1}$ ($C_{sb1}$ will be fixed when the length of the data line is fixed) will affect the feed-through voltage $dV_{sb}$ of the data line. As mentioned above, the channel-layer width W1 is proportional to the values of the parasitic capacitances $C_{gd1}$ and $C_{gs1}$. Accordingly, in this embodiment, the TFTs coupled with the data lines $D_n$ having different lengths are designed to have different channel-layer widths W1 so that the feed-through voltages $dV_{sb}$ of the data lines $D_n$ can be controlled, and therefore the problem of mura and flicker of the display panel 3 can be solved. Hence, the channel-layer width W1 of each of the TFTs can be determined according to the length (parasitic capacitance) of the corresponding data line connected to the TFT.

Moreover, the demultiplexing unit 33 includes a plurality of TFT groups, and each of the TFT groups is composed of at least two TFTs. In this embodiment, each of the TFT groups is composed of three TFTs T1~T3 for example. The TFTs can have the same channel-layer width W1, and the channel layers of the TFTs in the different TFT groups can have different widths W1.

In other words, as shown in FIG. 3A, the data lines $D_n$ can include a first data line $D_1$, a second data line $D_2$, and a third data line $D_3$, and the TFTs include a first TFT T1, a second TFT T2, and a third TFT T3. The first data line $D_1$ is coupled with the first TFT T1, the second data line $D_2$ is coupled with the second TFT T2, and the third data line $D_3$ is coupled with the third TFT T3. If the length of the second data line $D_2$ is greater than that of the first data line $D_1$ and is smaller than that of the third data line $D_3$, it can be controlled that the channel-layer width of the second TFT T2 is greater than that of the first TFT T1 and is smaller than that of the third TFT T3. In this case, since the length of the second data line $D_2$ is greater than that of the first data line $D_1$ and is smaller than that of the third data line $D_3$, a second capacitance (i.e. the parasitic capacitance $C_{sb2}$) of the second data line $D_2$ is greater than a first capacitance (i.e. the parasitic capacitance $C_{sb1}$) of the first data line $D_1$ and is smaller than a third capacitance (i.e. the parasitic capacitance $C_{sb3}$. Therefore, the channel-layer width of the second TFT T2 can be controlled to be greater than the channel-layer width of the first TFT T1 and smaller than the channel-layer width of the third TFT T3. When the channel-layer width W1 of the TFT is controlled, the value of the parasitic capacitance $C_{gd}$ is controlled thereby and the feed-through voltage $dV_{sb}$ can be thus controlled to make the feed-through voltages $dV_{sb}$ of the first, second, third data lines D1, D2, and D3 equal each other. When the all data lines in the non-rectangular display area 31 are considered in this manner and the channel-layer widths of the TFTs coupled with the data lines are controlled accordingly, the problem of mura and flicker of the display panel 3 can be solved.

To be noted, because the channel-layer width W1 of at least a TFT of the demultiplexing unit 33 is reduced in length according to the shorter data line, the layout space of the demultiplexing unit 33 can be reduced thereby, in comparison with the conventional demultiplexer. Besides, because the channel-layer width W1 of at least a TFT of the demultiplexing unit 33 is reduced in length according to the shorter data line, the parasitic capacitances $C_{gd}$ and $C_{gs}$ thereof also can be reduced, and the data driving circuit 32 can thus output the control signal CS with less power (the power is proportional to the capacitance value) to save energy.

Figure 5:
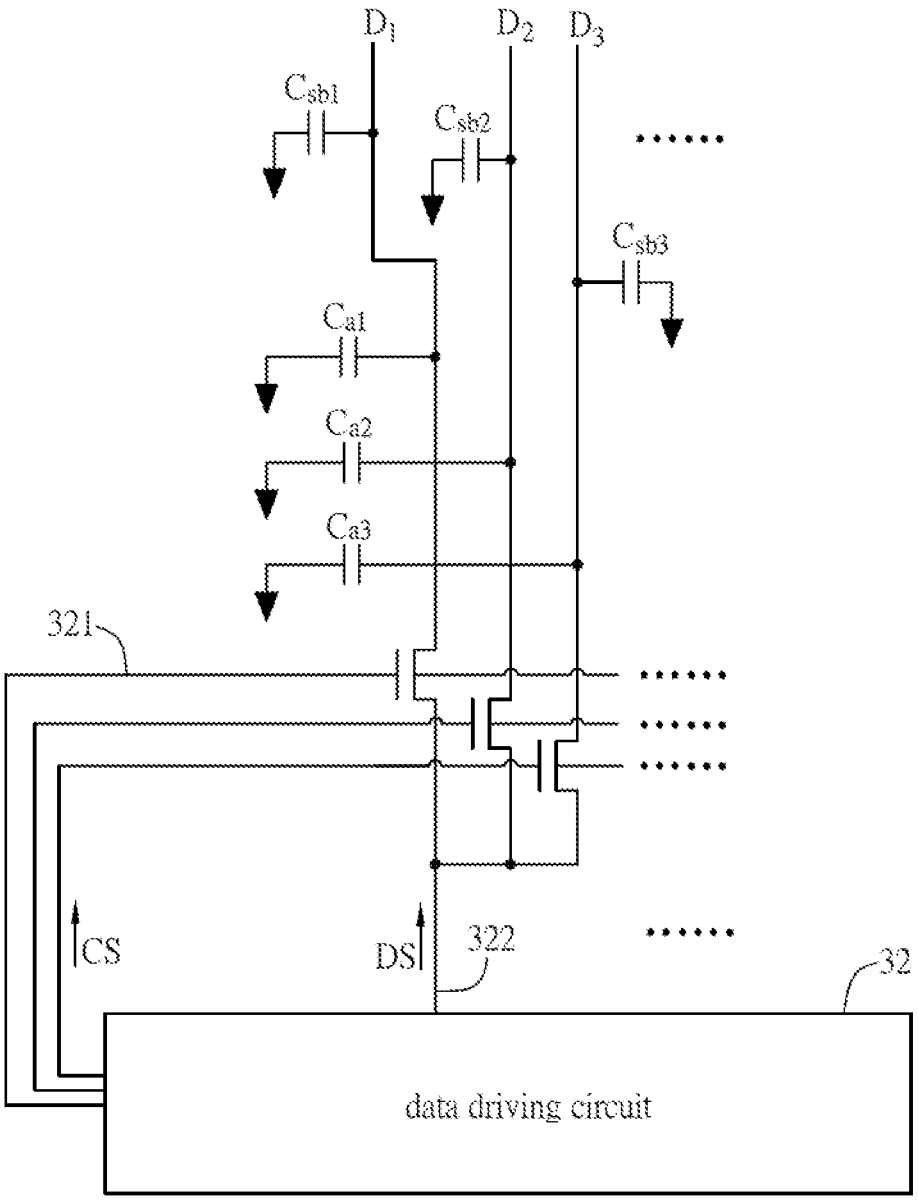
FIG. 5 is a schematic diagram of a variation of the data driving circuit and the demultiplexing unit connected to the data lines of the display panel in FIG. 2A.

FIG. 5 is a schematic diagram of a variation of the data driving circuit 32 and the demultiplexing unit 33 connected to the data lines of the display panel 3 in FIG. 2A.

As shown in FIG. 5, when the channel-layer width of each of the TFTs is fixed at a particular value, the corresponding parasitic capacitance $C_{gd}$ is also a fixed value. Moreover, from the above equation about the feed-through voltage $dV_{sb}$, it can be known that the feed-through voltage $dV_{sb}$ also can be controlled by controlling the parasitic capacitance $C_{sb}$ of the data line if the parasitic capacitance $C_{gd}$ can't be changed. Accordingly, if the TFT is designed to have a particular channel-layer width due to some consideration such as the process factor, an auxiliary capacitor $C_a$ (three auxiliary capacitors $C_{a1}$, $C_{a2}$, $C_{a3}$ are shown herein) can be added by the calculation to control the parasitic capacitance $C_{gd}$ and further to control the feed-through voltage $dV_{sb}$. One terminal of the auxiliary capacitor $C_a$ is coupled to the data line that is coupled with the TFT, and the other terminal of the auxiliary capacitor $C_a$ is coupled to an electrode, such as a grounding electrode, a common line, a gate line or a power line. The auxiliary capacitors $C_{a1}$, $C_{a2}$, $C_{a3}$ can have the same or different capacitances, according to the requirements. Since the feed-through voltage $dV_{sb}$ is controlled thereby, the problem of mura and flicker of the display panel 3 can be solved. In other embodiments, the other end of the auxiliary capacitors $C_{a1}$, $C_{a2}$, $C_{a3}$ can be coupled to one of the control signal lines 321 or to another electrode.

To be noted, the above-mentioned auxiliary capacitors can be made by many methods, and FIGS. 6A to 6F are schematic diagrams showing some methods for forming the auxiliary capacitor $C_a$.

Figure 6A:
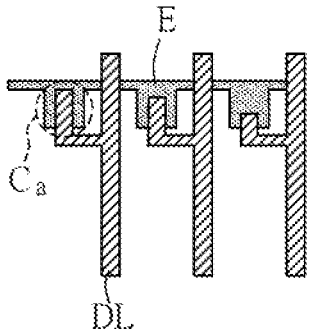
FIGS. 6A to 6F are schematic diagrams showing some methods for forming the auxiliary capacitor according to an embodiment of the invention.
Figure 6B:
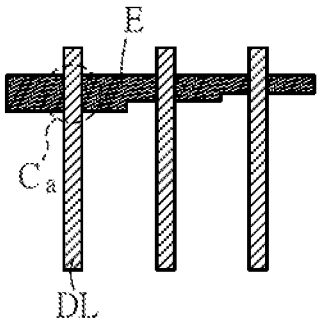
Figure 6C:
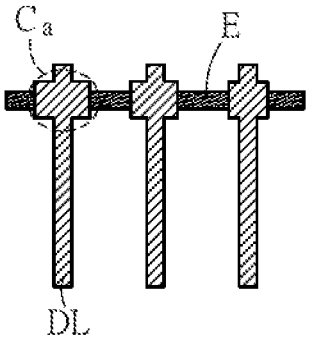
Figure 6D:
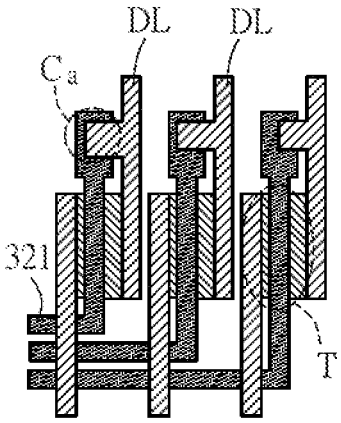
Figure 6E:
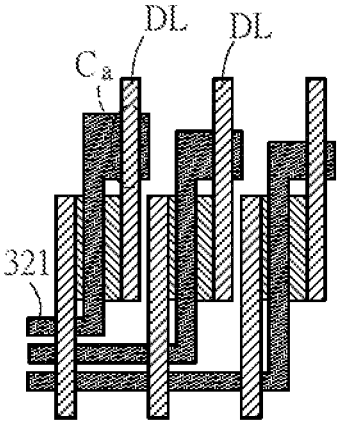
Figure 6F:
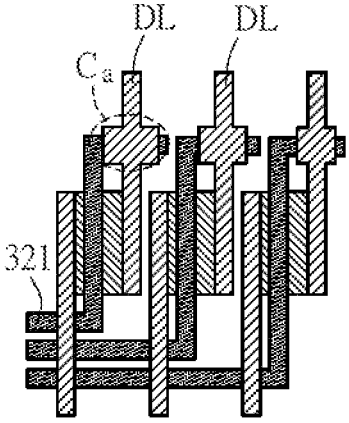

In FIGS. 6A to 6C an auxiliary capacitor $C_a$ is formed between a data line DL and an electrode E (such as a power line), and wherein the data line DL is insulated from the electrode E. And in FIGS. 6D to 6F the auxiliary capacitor $C_a$ is formed between the data line DL and the control signal line 321 of the demultiplexing unit 33, and wherein the data line DL is insulated from the control signal line 321. The auxiliary capacitors $C_a$ in FIGS. 6A and 6D are easier to be identified, but the auxiliary capacitors $C_a$ in FIGS. 6B, 6C, 6E, 6F are formed by the overlap between two electrodes so as to result in a higher layout efficiency. To be noted, in the above mentioned embodiment, as shown in FIGS. 6A to 6C, the capacitance of the auxiliary capacitors $C_a$ can be adjusted by changing the area in which the data line DL overlaps with the electrode E. Or, as shown in FIGS. 6D to 6F, the capacitance of the auxiliary capacitors $C_a$ can be adjusted by changing the area in which the data line DL overlaps with the control signal line 321. Moreover, the capacitance value of the auxiliary capacitor can be adjusted by changing the thickness of the insulating layer within the overlap of the two electrodes, and the insulating layer with greater thickness results in less capacitance value of the auxiliary capacitor while the insulating layer with less thickness results in greater capacitance value of the auxiliary capacitor. Besides, this kind of method of changing the thickness of the insulating layer won't affect the layout efficiency (however, it becomes hard to detect the capacitance value of the auxiliary capacitor).

To sum up, in the display panel of the invention, the data lines and the scan lines cross each other within the display area, and at least two data lines in the display area have different capacitances. Besides, the thin-film transistors of the demultiplexing unit receive the data signal and transmit the data signal to the correspondingly coupled data lines through channel layers of the thin-film transistors according to the control signals, and the channel layers of at least two of the thin-film transistors coupled with the at least two data lines have different widths. Accordingly, in the invention, the TFTs coupled to the data lines having different capacitances are controlled to have different widths of the channel layers, and the feed-through voltages of the data lines can be controlled. Therefore, the problem of mura and flicker of the display panel with non-rectangular display area can be avoided.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A display panel, comprising:

a display area;

a plurality of scan lines and a plurality of data lines in the display area, wherein at least two of the data lines have different lengths in the display area;

a data driving circuit outputting a plurality of control signals and a plurality of data signals;

a demultiplexing unit having a plurality of thin-film transistors coupled with the data driving circuit and the data lines, wherein the thin-film transistors receive the data signals and transmit the data signals to the correspondingly coupled data lines through the thin-film transistors according to the control signals; and at least two auxiliary capacitors, wherein the at least two auxiliary capacitors are coupled to the at least two data lines respectively, wherein one of the at least two auxiliary capacitors is formed by a first area which one of the at least two data lines overlapped the scan lines, and another one of the at least two auxiliary capacitors is formed by a second area which another one of the at least two data lines overlapped the scan lines, and the first area is different to the second area.

2. The display panel according to claim 1, wherein the display area is formed in a shape consisting of circle, shell, semicircle, oval, triangle, rhombus, trapezoid, polygon, or any combinations thereof.

3. The display panel according to claim 1, wherein one of the thin-film transistors (TFTs) has a control terminal receiving one of the control signals, an input terminal receiving one of the data signals and an output terminal outputting the data signal.

4. The display panel according to claim 3, wherein the data driving circuit is coupled with the control terminal of the TFT through a control signal line.

5. The display panel according to claim 3, wherein the data driving circuit is coupled with the input terminal of the TFT through a data signal line.

6. The display panel according to claim 1, wherein a length of one of the at least two data lines in the display area is greater than a length of another one of the at least two data lines in the display area, and the first area is greater than the second area.

7. A display panel, comprising:

a display area;

a plurality of scan lines and a plurality of data lines in the display area, wherein at least two of the data lines have different lengths in the display area;

a data driving circuit outputting a plurality of controls signal and a plurality of data signals;

a demultiplexing unit having a plurality of thin-film transistors coupled with the data driving circuit and the data lines, wherein the thin-film transistors receive the data signals and transmit the data signals to the correspondingly coupled data lines according to the control signals; and at least two auxiliary capacitors, wherein the at least two auxiliary capacitors are coupled to the at least two data lines respectively, wherein one of the at least two auxiliary capacitors is coupled to the scan lines and another one of the at least two auxiliary capacitors is coupled to a power line.

8. The display panel according to claim 7, wherein the display area is formed in a shape consisting of circle, shell, semicircle, oval, triangle, rhombus, trapezoid, polygon, or any combinations thereof.

9. The display panel according to claim 7, wherein one of the thin-film transistors (TFTs) has a control terminal receiving one of the control signals, an input terminal receiving one of the data signals and an output terminal outputting the data signal.

10. The display panel according to claim 9, wherein the data driving circuit is coupled with the control terminal of the TFT through a control signal line.

11. The display panel according to claim 9, wherein the data driving circuit is coupled with the input terminal of the TFT through a data signal line.

12. A display panel, comprising:

a display area;

a plurality of scan lines and data lines in the display area, wherein at least two of the data lines have different lengths in the display area;

a data driving circuit outputting a plurality of control signals and a plurality of data signals;

a demultiplexing unit having a plurality of thin-film transistors coupled with the data driving circuit and the data lines, wherein the thin-film transistors receive the data signals and transmit the data signals to the correspondingly coupled data lines through the thin-film transistors according to the control signals; and at least two auxiliary capacitors, wherein the at least two auxiliary capacitors are coupled to the at least two data lines respectively, wherein at least two different areas respectively corresponding to the at least two auxiliary capacitors are overlapped by the at least two data lines and the scan lines respectively.

13. The display panel according to claim 12, wherein the display area is formed in a shape consisting of circle, shell, semicircle, oval, triangle, rhombus, trapezoid, polygon, or any combinations thereof.

14. The display panel according to claim 12, wherein one of the thin-film transistors (TFTs) has a control terminal receiving one of the control signals, an input terminal receiving one of the data signals and an output terminal outputting the data signal.

15. The display panel according to claim 14, wherein the data driving circuit is coupled with the control terminal of the TFT through a control signal line.

16. The display panel according to claim 14, wherein the data driving circuit is coupled with the input terminal of the TFT through a data signal line.

* * * * *